US006410490B1

(12) United States Patent
Reyes-Gavilan et al.

(10) Patent No.: US 6,410,490 B1
(45) Date of Patent: Jun. 25, 2002

(54) STABILIZED HYDROTREATED AND HYDROWAXED LUBRICANT COMPOSITIONS

(75) Inventors: Jose L. Reyes-Gavilan, Clifton, NJ (US); Frederick T. Lichtenberg, Hartsdale, NY (US); Adesola O. Oshode, Bronx, NY (US); Miles J. Hutchings, Eastchester, NY (US); Peter Collen Hamblin, Flüg (CH); Michael Fletschinger, Bad Krozingen-Biengen (DE); Peter Rohrbach, Liestal (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/573,402

(22) Filed: May 18, 2000

Related U.S. Application Data

(60) Provisional application No. 60/134,805, filed on May 19, 1999.

(51) Int. Cl.[7] ..... C10M 141/08; C10M 141/06

(52) U.S. Cl. ..... 508/243; 508/262; 508/279; 508/281

(58) Field of Search ..... 508/279, 281, 508/243, 262

(56) References Cited

U.S. PATENT DOCUMENTS

| | | | | |
|---|---|---|---|---|
| 3,493,493 | A | 2/1970 | Henke et al. | 208/264 |
| 3,562,149 | A | 2/1971 | Bryson et al. | 208/143 |
| 3,761,388 | A | 9/1973 | Bryson et al. | 208/59 |
| 3,763,033 | A | 10/1973 | Stauffer et al. | 208/78 |
| 3,764,518 | A | 10/1973 | Henke et al. | 208/80 |
| 3,803,027 | A | 4/1974 | Christman et al. | 208/111 |
| 3,941,680 | A | 3/1976 | Bryson et al. | 208/80 |
| 4,285,804 | A | 8/1981 | Jacquin et al. | 208/48 |
| 4,701,273 | A | 10/1987 | Brady et al. | 252/32.5 |
| 4,734,209 | A | 3/1988 | Phillips et al. | 252/47 |
| 4,822,476 | A | 4/1989 | Ziemer et al. | 208/59 |
| 4,824,601 | A | 4/1989 | Franklin | 252/401 |
| 5,580,482 | A | 12/1996 | Chasan et al. | 508/243 |

FOREIGN PATENT DOCUMENTS

WO 93/02165 2/1993

*Primary Examiner*—Jacqueline V. Howard
(74) *Attorney, Agent, or Firm*—Tyler A. Stevenson; Luther A. R. Hall

(57) ABSTRACT

The instant invention relates to a lubricant composition stabilized against the deleterious effects of heat and oxygen. The composition comprises a hydrotreated or hydrodewaxed oil and an effective antioxidant stabilizing amount of a mixture of a phenolic antioxidant; an N,N-disubstituted aminomethyl-1,2,4-triazole; an aromatic amine antioxidant; an alkyl phenoxy alkanoic acid; and an N-acyl sarcosine derivative. Optionally, further additives are added to the subject lubricant compositions.

27 Claims, No Drawings

STABILIZED HYDROTREATED AND HYDROWAXED LUBRICANT COMPOSITIONS

This application claims benefit under 35 USC 119(e) of U.S. Provisional Application No. 60/134,805, filed May 19, 1999.

The instant invention is directed to a lubricant composition stabilized against the deleterious effects of heat and oxygen, said composition comprising a hydrotreated or hydrodewaxed oil and an effective antioxidant stabilizing amount of a mixture of a phenolic antioxidant; an N,N-disubstituted aminomethyl-1,2,4triazole; an aromatic amine antioxidant; an alkyl phenoxy alkanoic acid; and an N-acyl sarcosine derivative.

The instant compositions find utility in industrial lubricant applications such as, for example, compressor, hydraulic, turbine oils and the like.

BACKGROUND OF THE INVENTION

It is known that lubricants are readily susceptible to decomposition and thus require the addition of various stabilizers and other additives in order to improve performance characteristics. Degradation of the lubricant is primarily due to the action of heat, mechanical stress, especially induced boy shear forces, and chemical reagents, especially atmospheric oxygen. Deterioration of the lubricant results in an increase in total acidity, formation of gums, discoloration and loss of physical properties such as viscosity, loss of potency, polymerization, rancidity and/or unpleasant odor. In the case of lubricating oils used at elevated temperatures, it is particularly desirable for the lubricant to resist oxidation, especially to minimize the formation of sludge and increase in total acidity of the oil, and the consequent lowering of the lubricating ability of the oil and lubricating system in general.

Accordingly, stabilizers are added to the lubricant in order to retard or eliminate degradation, thereby extending the life of the lubricant. For example, U.S. Pat. No. 5,580,482 relates to the stabilization of triglyceride oils subject to oxidative degradation by the addition of either an N,N-disubstituted aminomethyl-1,2,4-triazole or an N,N-disubstituted aminomethylbenzotriazole; a higher alkyl substituted amide of dodecylene succinic acid; a phenolic antioxidant; and an aromatic amine antioxidant. U.S. Pat. No. 4,652,385 discloses that hydrotreated oils are stabilized by addition thereto of a phosphite or diphosphite and a sterically hindered phenolic antioxidant.

It has now been found that incorporating in a hydrotreated or hydrodewaxed oil a certain combination of metal deactivator, metal corrosion inhibitor, sterically hindered phenolic antioxidant, aromatic amine antioxidant leads to surprisingly outstanding performance characteristics.

OBJECTS OF THE INVENTION

One object is to provide a lubricant composition which meets the requirements of oxidative, corrosion and thermal stability, robustness in use and calcium compatibility by incorporating therein the stabilizer package in accordance with the instant invention.

Another object is to provide a process for stabilizing a lubricant by incorporating therein an effective stabilizing amount of the stabilizer mixture in accordance with the instant invention.

DETAILED DISCLOSURE

The present invention pertains to a lubricant composition stabilized against the deleterious effects of heat and oxygen, which composition comprises (a) a hydrotreated oil or a hydrodewaxed oil;

(b) (i) an effective stabilizing amount of a metal deactivator of the formula (I)

(I)

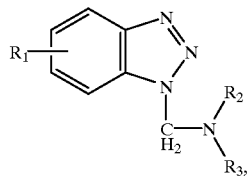

wherein $R_1$ is hydrogen or $C_1$–$C_{12}$alkyl, and $R_2$ and $R_3$, each independently of the other, are hydrogen, $C_1$–$C_{20}$alkyl, $C_3$–$C_{20}$alkenyl, $C_5$–$C_{12}$cycloalkyl, $C_7$–$C_{13}$aralkyl, $C_6$–$C_{10}$aryl, hydroxy, or $R_2$ and $R_3$, together with the nitrogen to which they are bonded, form a 5-, 6- or 7-membered heterocyclic residue or $R_2$ and $R_3$ is each a residue of the formula (II)

$$R_4X[(\text{alkylene})O]_n(\text{alkylene})— \quad \text{(II)},$$

wherein

X is O, S or $NR_4$;

$R_4$ is hydrogen or $C_1$–$C_{20}$alkyl;

alkylene is a $C_1$–$C_{12}$alkylene residue; and n is 0 or an integer from 1 to 6; or $R_2$ is as defined above and $R_3$ is a residue of the formula (III)

(III)

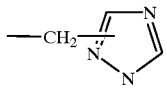

or is a residue of the formula (II) as defined above and $R_2$ is a residue of the formula (IV)

$$-[\text{alkylene}]_n—N(R_5)—A—[N(R_5)_2]_m \quad \text{(IV)},$$

wherein m is 0 or 1 and, when m is 0, A is a residue of the formula (III) and, when m is 1, A is alkylene or $C_6$–$C_{10}$ arylene; and alkylene and n have their above-mentioned meanings; and $R_5$ is a residue of the formula (III), as defined above; or (ii) an effective stabilizing amount of a metal deactivator of the formula (V)

(V)

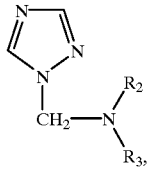

wherein $R_2$ and $R_3$ are as defined above;

(c) an effective stabilizing amount of a sterically hindered phenolic antioxidant;

(d) an effective stabilizing amount of an aromatic amine antioxidant;

(e) an effective stabilizing amount of an alkyl phenoxy alkanoic acid of the formula (VI)

(VI)

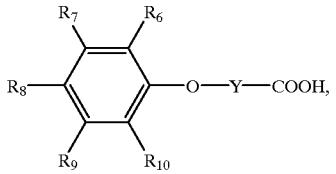

wherein $R_6$, $R_7$, $R_8$, $R_9$ and $R_{10}$ are, each independently of the other, hydrogen or $C_1$–$C_{20}$alkyl and Y is a divalent $C_1$–$C_{20}$ hydrocarbon radical, saturated or unsaturated, selected from the group consisting of

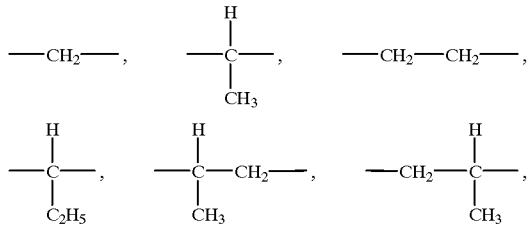

(f) an effective stabilizing amount of an N-acyl sarcosine derivative of the formula (VII)

(VII)

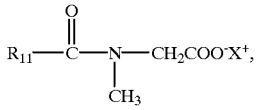

wherein the acyl group $R_{11}$—C(═O)— is the residue of a fatty acid having 10 to 20 carbon atoms and $X^+$ is the hydrogen ion, an alkali metal ion or an ammonium ion.

The compositions of the invention are prepared from hydrotreated or hydrodewaxed lubricating oil. The hydrotreated oils are prepared from vacuum gas oil fractions which have been subjected to a two-stage high-hydrogen-pressure hydrotreating process in the presence of active zeolite catalysts. The disclosures of U.S. Pat. Nos. 3,493,493; 3,562,149; 3,761,388; 3,763,033; 3,764,518; 3,803,027; 3,941,680; and 4,285,804, each herein incorporated by reference, provide various details of such hydrotreating process. In the first stage of a typical hydrotreatment process, the hydrogen pressure is in the vicinity of 20 Mpa and the temperature is maintained at about 390° C., using a fluorided Ni—W catalyst on a silica-alumina support; nitrogen-, sulfur- and oxygen-containing compounds are almost entirely removed from the feedstock, and other effects include a high degree of saturation of aromatics and a high degree of ring scission of the polycyclic intermediates. Lubricating oil fractions from the first stage are dewaxed and subjected to further hydrogen treatment in the presence of a catalyst, for example, Ni—W on a silica aluminum support, at lower temperature than the first stage. Aromatics and olefins are further saturated in this stage. The product oil contains substantially no sulfur or nitrogen, and only trace amounts of aromatics, being substantially entirely composed of saturates including paraffins and cycloparaffins. The compositions can also be used in solvent refined base stocks. Solvent refined oils are defined as Group I oils.

The hydrodewaxed oils are prepared from a hydrocracked, solvent dewaxed lube oil base stock by contacting the base stock with hydrogen in the presence of a multilayered catalyst system. In the first layer, the hydrocracked, solvent dewaxed stock is catalytically dewaxed, using, for example, an aluminosilicate catalyst. In the second layer, the catalytically dewaxed stock is hydrofinished, using, for example, a palladium hydrotreating catalyst having alumina or siliceous matrix. U.S. Pat. No. 4,822,476, herein incorporated by reference, discloses the details of this process.

The resulting hydrotreated lubricant base oils obtained by the processes described above are defined as Group II oils when their viscosity index, an indication of the change in viscosity with temperature, is equal to or below 120. They are defined as Group III oils when their viscosity index is above 120.

The metal deactivator which is used in accordance with the instant invention is an N,N-disubstituted aminomethylbenzotriazole of the formula (I) or an N,N-disubstituted aminomethyl-1,2,4-triazole, or mixtures thereof. To those mixtures or products unsubstituted tolutriazole or benzotriazole may be added. The N,N-disubstituted aminomethylbenzotriazole can be prepared by known methods, as described, for example, in U.S. Pat. No. 4,701,273, such as reacting a benzotriazole with formaldehyde and an amine, $HNR_2R_3$,. Preferably, $R_1$ is hydrogen or methyl. The N,N-disubstituted aminomethyl-1,2,4triazole compounds can be similarly prepared, namely by reacting a 1,2,4-triazole with formaldehyde and an amine, $HNR_{35}R_{36}$, as described in U.S. Pat. No. 4,734,209.

Preferably, the metal deactivator is 1-[bis(2-ethylhexyl) aminomethyl-4-methylbenzotriazole or 1-[bis(2ethylhexyl) aminomethyl]-1,2,4-triazole, available from CIBA under the product names IRGAMET® 39 and IRGAMET® 30, respectively.

Throughout the specification the products identified with trade marks from CIBA and product names are obtainable from CIBA Ltd. Basel Switzerland or CIBA Corporation, Tarrytown, N.Y.

The sterically hindered phenolic antioxidants which comprise component (c) of the present lubricant compositions are known and include, but are not limited to, the following compounds or classes of compounds:

Alkylated Monophenols 2,6-di-tert-butyl-4-methylphenol, 2,6di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-i-butylphenol, 2,6-di-cyclopentyl-4-methylphenol, 2-(beta-methylcyclohexyl)-4,6-dimethylphenol, 2,6-di-octadecyl-4-methylphenol, 2,4,6-tri-cyclohexylphenol, 2,6-di-tert-butyl-4-methoxymethylphenol, o-tert-butylphenol.

Alkylated Hydroquinones 2,6-Di-tert-butyl-4-methoxyphenol, 2,5-di-tert-butyl-hydroquinone, 2,5-di-tert-amyl-hydroquinone, 2,6-diphenyl4octadecyloxyphenol.

Hydroxylated Thiodiphenyl Ethers 2,2'-Thio-bis-(6-tert-butyl-4-methylphenol), 2,2'-thio-bis-(4-octyl-phenyl), 4,4'-thio-bis-(6-tert-butyl-3-methylphenol), 4,4'-thio-bis-(6-tert-butyl-2-methylphenol).

Alkylidene-Bisphenols 2,2'-Methylene-bis-(6-tert-butyl-4-methylphenol), 2,2'-methylene-bis-(6-tert-butyl-4-ethylphenol), 2,2'-methylene-bis-(4-methyl-6-(alpha-methyl-cyclohexyl)-phenol), 2,2'-methylene-bis-(4-methyl-6(alpha-methylcyclohexyl-phenol), 2,2'-methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis-(4,6-di-tert-butylphenol), 2,2'-thylidene-bis-(6-tert-butyl-4- or -5-isobutylphenol), 2,2'-methylene-bis-(6(alpha-methylbenzyl)-4-nonylphenol), 2,2'-methylene-bis-(6-(alpha,alpha-di-methylbenzyl)-4-nonylphenol), 4,4'-methylene-bis-(2,6-di-tert-butylphenol), 4,4'-methylene-bis-(6-tert-butyl-2-methylphenol), 1,1-bis-(5-tert-butyl-4-hydroxy-2-methylphenol)butane, 2,6-di-(3-tert-butyl-5-methyl-2-hydroxybenzyl)-4-methylphenol, 1,1,3-tris-(5-tert-butyl-4-hydroxy-2-methylphenyl)-3-n-dodecyl)mercaptobutane, ethyleneglycol-bis-[3,3-bis(3'-tert-butyl-4'-hydroxyphenyl)butyrate], bis-(3-tert-butyl-4-hydroxy-5-methylphenyl)-dicyclopentadiene, bis-[2-(3'-tert-butyl-2'-hydroxy-5'-methylbenzyl)-6-tert-butyl-4-methylphenyl]terephthalate.

Benzyl Compounds 1,3,5-Tri-(3,5-di-tert-butyl-4-hydroxybenzyl)-2,4,6trimethyl benzene, bis(3,5-di-tert-butyl-4-hydroxybenzyl) sulfide, 3,5-di-tert-butyl-4-hydroxybenzyl mercaptoacetic acid-isooctyl ester, bis-(4-tert-butyl-3-hydroxy-2,6dimethylbenzyl)dithiolterephthalate, 1,3,5-tris-(3,5-di-tert-butyl-4-hydroxybenzyl)isocyanurate, 1,3,5tris-(4-tert-butyl-3-hydroxy-2,6dimethylbenzyl)isocyanurate, 3,5-di-tert-butyl-4-hydroxybenzyl phosphonic acid-dioctadecyl ester, 3,5-di-tert-butyl-4-hydroxybenzyl phosphonic acid-monoethyl ester, calcium salt.

Acylaminophenols

4-Hydroxylauric acid anilide, 4-hydroxystearic acid anilide, 2,4-bis-octylmercapto-6-(3,5-di-tert-butyl-4-hydroxyanilino)-s-triazine, N-(3,5-di-tert-butyl-4-hydroxyphenyl)carbamic acid octyl ester; and others:

Esters of beta-(3,5-di-tert-4-butyl-4-hydroxyphenyl)-propionic acid with mono- or polyhydric alcohols, for example with methanol, isooctyl alcohol, 2-ethylhexanol, diethylene glycol, octadecanol, triethylene glycol, 1,6-hexanediol, pentaerythritol, neopentyl glycol, tris-hydroxyethyl isocyanurate, thiodiethylene glycol, bis-hydroxyethyl oxalic acid diamide;

Esters of beta-(5-tert-butyl-4-hydroxy-3-methylphenyl) propionic acid with mono- or polyhydric alcohols, for example with methanol, isooctyl alcohol, 2-ethylhexanol, diethylene glycol, octadecanol, triethylene glycol, 1,6-hexanediol, pentaerythritol, neopentyl glycol, tris-hydroxyethyl isocyanurate, thiodiethylene glycol, di-hydroxyethyl oxalic acid diamide;

Amides of beta-(3,5-di-tert-butyl-4-hydroxyphenyl) propionic acid, for example N,N'-bis-(3,5-di-tert-butyl-4-hydroxyphenylpropionyl)hexamethylene diamine, N,N'-bis-(3,5-di-tert-butyl-4hydroxyphenylpropionyl)trimethylene diamine, N,N'-bis(3,5-di-tert-butyl-4-hydroxyphenyl-propionyl) hydrazine;

Sterically hindered phenolic antioxidants of particular interest are selected from the group consisting of 2,6-di-tert-butylphenol (IRGANOX® L 140, CIBA), BHT, 2,2'-methylene bis-(4,6-di-tert-butylphenol), 1,6-hexamethylene-bis-(3,5-di-tert-butyl-hydroxyhydrocinnamate) (IRGANOX® L109, CIBA, ((3,5-bis(1,1-dimethylethyl)-4-hydroxyphenyl)methyl)thio)acetic acid, $C_{10}$–$C_{14}$isoalkyl esters (IRGANOX® L118, CIBA, 3,5-di-tert-butyl-4-hydroxyhydrocinnamic acid, $C_6$–$C_9$alkyl esters (IRGANOX® L135, CIBA,) tetrakis-(3-(3,5-di-tert-butyl-4-hydroxyphenyl)-propionyloxymethyl)methane (IRGANOX® 1010, CIBA), thiodiethylene bis(3,5-di-tert-butyl-4-hydroxyhydrocinnamate (IRGANOX® 1035, CIBA), octadecyl 3,5-di-tert-butyl-4-hydroxyhydrocinnamate (IRGANOX® 1076, CIBA) and 2,5-di-tert-butylhydroquinone. These products are known and are commercially available. Of most particular interest is 3,5-di-tert-butyl-4-hydroxy-hydrocinnamic acid-$C_7$–$C_9$-alkyl ester.

The aromatic amine antioxidants which comprise component (d) of the present lubricant compositions are known and include, but are not limited to, the following compounds:

N,N'-Di-isopropyl-phenylenediamine, N,N'-di-sec-butyl-p-phenylenediamine, N,N'-bis(1,4-dimethyl-pentyl)-p-phenylenediamine, N,N'-bis(1-ethyl-3methyl-pentyl)-p-phenylene-diamine, N,N'-bis(1-methyl-heptyl)-p-phenylenediamine, N,N'-dicyclohexyl-p-phenylene-diamine, N,N'-diphenyl-p-phenylenediamine, N,N'-di(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N'-cyclohexyl-N'-phenyl-p-phenylenediamine, 4-(p-toluene-sulfonamido) diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, e.g. p,p'-di-tert-octyldiphenylamine, 4-n-butylamino-phenol, 4-butyrylaminophenol, 4-nonanoylaminophenol, 4-dodecanoylaminophenol, 4-octade-canoylaminophenol, di(4-methoxyphenyl)amine, 2,6-di-tert-butyl-4-dimethylaminomethylphenol, 2,4'-diaminodiphenyl-methane, 4,4'-diaminodiphenylmethane, N,N,N',N'-tetramethyl-4,4'-diaminodiphenylmethane, 1,2-di(phenylamino)ethane, 1,2-di[(2-methylphenyl)amino] ethane, 1,3-di(phenylamino)propane, (o-tolyl)biguanide, di[4-(1',3'-dimethylbutyl)phenyl]amine, tert-octylated N-phenyl-1-naphthylamine, mixture of mono- and dialkylated tert-butyl-/tert-octyldiphenylamines, 2,3-dihydro-3,3-dimethyl-4H-1,4-benzothiazine, phenothiazine, N-allylphenothiazine, tert-octylated phenothiazine, 3,7-di-tert-octylphenothiazine.

Component (d) of the lubricant composition comprises a preferred group of aromatic amine antioxidants of the formula (VIII)

(VIII)

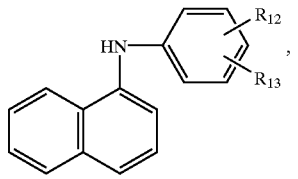

wherein $R_{12}$ and $R_{13}$ are, each independently of the other, hydrogen or $C_1$–$C_{24}$ alkyl. Preferably $R_{12}$ is hydrogen and $R_{13}$ is hydrogen or $C_8$–$C_{13}$alkyl. Also of particular interest is a compound of the formula (IX)

(IX)

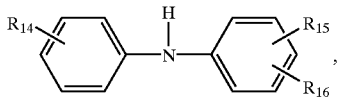

wherein $R_{14}$, $R_{15}$ and $R_{16}$ are, each independently of the other, hydrogen or $C_1$–$C_{24}$alkyl and are preferably hydrogen or $C_4$–$C_{18}$alkyl. Of most particular interest is where the aromatic amine stabilizer comprises a mixture of alkylated diphenylamines such that $R_{14}$, $R_{15}$ and $R_{16}$ are independently hydrogen, $C_4H_9$ and $C_8H_{17}$. These aromatic amine stabilizers are known, with some being commercially available, and are described, for example in U.S. Pat. No. 4,824,601.

Component(e) of the lubricant composition comprises alkyl phenoxy alkanoic acids of the formula VI. These compounds are known per se with many being commercially available. Examples include phenoxy acetic acid, p-methyl phenoxy acetic acid, p-isopropyl phenoxy acetic acid, p-octyl phenoxy acetic acid, p-nonyl phenoxy acetic acid, p-dodecyl phenoxy acetic acid, p-(alpha-methyl-methyl-nonadecyl)phenoxy acetic acid, p-tertiary amyl phenoxy acetic acid, 2,4-di-tert-amyl phenoxy acetic acid, 2,4-di-sec-amyl phenoxy acetic acid, 2,4-dinonyl phenoxy acetic acid and 2-methyl-6-tert-butyl phenoxy acetic acid. Preferred are $C_5$–$C_{18}$alkyl phenoxy alkanoic acids such as p-tertiary amyl phenoxy acetic acid, p-octyl phenoxy acetic acid, p-nonyl phenoxy acetic acid, p-dodecyl phenoxy acetic acid and 2,4-dinonyl phenoxy acetic acid. Most preferred is p-nonyl phenoxy acetic acid.

Component (f) of the lubricant composition comprises N-acyl sarcosine derivatives of the formula VII. These compounds are known per se, a number of which are commercially available. Representative of this class of compounds are lauroyl sarcosine, cocyl sarcosine, oleoyl sarcosine, stearoyl sarcosine, tall oil acyl sarcosine, and the corresponding alkali metal or ammonium sarcosinates. The preferred sarcosine compound is one wherein the acyl group has from 12 to 18 carbon atoms. Most preferred is where $R_{11}$ is —$C_{17}H_{33}$ and X is hydrogen.

Optional Components

The lubricant composition may contain, in addition to the components a)–f), the following optional components:

An effective stabilizing amount of a polyol partial ester. Suitable polyol partial esters are selected from the group of mono-and di-glycerides, monoacetylated and diacetylated monoglycerides, polyglycerol fatty acid esters, sorbitan fatty acid esters and partial fatty acids esters of polyoxyethylene sorbitan. Suitable mono-and di-glycerides are derived from glycerol by the esterification of one or two hydroxy groups with one or two acid radicals of saturated or unsaturated carboxylic acids having an even number of from 8 to 20 carbon atoms.

The acid radical of a saturated carboxylic acid having an even number of from 8 to 20 carbon atoms that esterifies the polyglycerol base structure is preferably straight-chain and has 12, 14, 16 or 18 carbon atoms, for example n-dodecanoyl, n-tetradecanoyl, n-hexadecanoyl or n-octadecanoyl.

The acid radical of an unsaturated carboxylic acid having even number of from 8 to 20 carbon atoms that esterifies the glycerol base structure is preferably straight-chain and has 12, 14, 16 or 18 carbon atoms and one double bond, for example, 9-cis-dodecenoyl, 9-cis-tetradecenoyl, 9-cis-hexadecenoyl or 9-cis-octadecenoyl.

The following names are also customary for the mentioned acid radicals: 9-cis-dodecenoyl (lauroleoyl), 9-cis-tetradecenoyl (myristoleoyl), 9cis-hexadecenoyl (palmitoleoyl), 6-cis-octadecenoyl (petroseloyl), 6-trans-octadecenoyl (petroselaidoyl), 9-cis-octadecenoyl (oleoyl), 9-trans-octadecenoyl (elaidoyl), 11-cis-octadecenoyl (vaccenoyl), 9-cis-icosenoyl (gadoleoyl), n-dodecanoyl (lauroyl), n-tetradecanoyl (myristoyl), n-hexadecanoyl (palmitoyl), n-octadecanoyl (stearoyl), n-icosanoyl (arachidoyl).

Especially suitable mono- and di-glycerides are available commercially under the names Loxiol® G 10 and G 16 (Henkel), Nutrisoft® 100 (Grünau), Kessco GMO (Akzo) and Ede-nor® GMO, GDO (Henkel), Emerest 2421 (Henkel).

A suitable monoacetylated or diacetylated monoglyceride is a monoglyceride that has, in addition to the acyl radical or a fatty acid, preferably one or two acetyl radicals. The acyl radical is derived preferably from one of the mentioned unsaturated fatty acids having an even number of more than ten carbon atoms. A monoglyceride obtainable from a mixture of monacetylated or diacetylated monoglycerides using customary methods of separation, e.g. fractional distillation, is preferred.

Acetylated monoglycerides commercially obtainable under the trademark MYVACET (Eastman) are especially prepared. Acetylated monoglycerides of the MYVACET series are used industrially as lubricants, plasticizers, non-ionic emulsifiers and solubilizers. Especially preferred are the products obtainable commercially under the name MYVACET 5-07, 7-00, 7-07, 9-08, 9-40 and 9-45 K.

A suitable polyglycerol fatty acid ester consists of a substantially pure polyglycerol fatty acid ester or a mixture of different polyglycerol fatty acid esters wherein the polyglycerol base structure contains preferably up to and including 10 glycerol units that are esterified by from 1 to 10 acid radicals of the mentioned saturated or unsaturated carboxylic acids having an even number of from 8 to 20 carbon atoms.

Suitable polyglycerol fatty acid esters having a uniformly defined structure are, for example, diglycerol monocaprate, diglyceryl monolaurate, diglycerol diisostearate, diglycerol monoisostearate, diglycerol tetrastearate (polyglyceryl 2-tetrastearate), triglycerol monooleate (polyglyceryl 3-monooleate), triglycerol monolaurate, triglycerol monostearate (polyglyceryl 3-stearate), triglycerol monoisostearate, hexaglycerol dioleate (polyglycerol 6-dioleate), hexaglycerol distearate (polyglycerol 6-distearate), decaglycerol dioleate (polyglycerol 10-dioleate), decaglycerol tetraoleate (polyglycerol 10-tetraoleate), decaglycerol decaoleate (polyglycerol 10-decaoleate), decaglyerol decastearate (polyglycerol 10-decastearate). The CTFA nomenclature is given in brackets. Those products are available commercially under the trademarks Caprol® (trademark of Karlshamns USA inc., Columbus Ohio). Specific product names: CAPROL 2G4S, 3GO, 3GS, 6G2O, 6G2S, 10G2O, 10G4O, 10G10O, 10G10S. Further products are available under the names DGLC-MC, DGLC-ML, DGLC-DISOS, DGLC-MISOS, TGLC-ML and TGLC-MISOS from Solvay Alkali GmbH, D-3002 Hannover.

Mixtures of different polyglycerol fatty acids esters are defined by names such as decaglycerol mono-and dioleate, polyglycerol ester of mixed fatty acids, polyglycerol esters of fatty acids, and polyglycerol caprate, cocoate, laurate, lanolinate, isostearate and ricinolate and are available commercially under the trademarks Triodan® and Homodan® (trademark of Grindsted Products, Grindsted Denmark), specific product names: TRIODAN 20, 55, R90 and HOMODAN MO, Radiamuls® (trademark of Petrofina (FINA), Brussels, Belgium), specific product name RADIAMULS poly 2253, and the name CAPROL PGE860 or ET, or the trademark Plurol® (trademark of Gattefossé Etablissements, Saint-Priest, France), specific product name PLUROL Stearique WL1009 or PLUROL Oleique WL 1173. Further products are available under the manes PGLC-C1010s, PGLC-C0810, PGLC-C1010/S, PGLC-LT2010, PGLC-LAN0510/S, PGLC-CT2010/90, PGLC-ISOSTUE, PGLC-RUE and PGLC-ISOS0410 from Solvay Alkali GmbH, D-3002 Hannover.

A suitable sorbitan fatty acid ester consists preferably of a substantially pure sorbitan fatty acid ester of a mixture of different sorbitan fatty acid esters wherein the sorbitan base structure is esterified by from 1 to 3 acid radicals of one of the mentioned saturated or unsaturated straight-chain carboxylic acids having an even number of from 8 to 20 carbon atoms.

Suitable sorbitan fatty acid esters are especially sorbitan monolaurate, monopalmitate, monostearate, tristearate, monooleate, sesquioleate and trioleate. Those products are available commercially under the trademarks Span® (trademark of Atlas, Wilmington USA), specific product names: SPAN 20, 40, 60, 65, 80 and 85, Arlacel® (trademark of Atlas), specific product names: ARLACEL 20, 40, 60, 80, 83, 85 and C, Crill® (trademark of Croda Chemicals Ltd., Cowick Hall, Snaith Goole GB), specific product names: CRILL 1, 3 and 4, Dehymuls® (trademark of Henkel, Düsseldorf DE), specific product names: DEHYMULS SML, SMO, SMS, SSO, Famodan® (trademark of Grindsted Products, Grindsted Denmark), specific product names: FAMODAN MS, and TS, Capmul® (trademark of Karishamns USA Inc., Columbus, Ohio), specific product names: CAPMUL S and O, and Radiasurf® (trademark of Petrofina (FINA), Brussels, Belgium), specific product names: RADIASURF 7125, 7135, 7145 and 7155.

The mentioned partial fatty acid ester of polyoxyethylene sorbitan consists preferably of a substantially pure ester of sorbitan or a mixture of different esters of sorbitan I which the structure of the fatty acid groups and the length of the polyoxyethylene chains vary. The sorbitan is preferably etherified by the three polyoxyethylene chains and esterified by one fatty acid group. Alternatively, however, the sorbitan may be etherified by only one or two polyoxyethylene chains and accordingly esterified by two or three fatty acid groups.

Altogether, the sorbitan base structure is substituted by a minimum of two and a maximum of four hydrophilic groups, the polyoxyethylene chains and the fatty acid groups being covered by the term "hydrophilic groups".

The polyoxyethylene chain is straight-chain and has preferably from 4 to 10, especially from 4 to 8, ethylene oxide units. The ester groups on the sorbitan base structure are derived from a saturated or unsaturated, straight-chain carboxylic acid having an even number of from 8 to 20 carbon atoms. The ester group derived from that carboxylic acid is preferably straight-chain and has 12, 14, 16 or 18 carbon atoms, e.g. n-dodecanoyl, n-tetradecanoyl, n-hexadecanoyl or n-octadecanoyl. The ester group derived from an unsaturated carboxylic acid having an even number of from 8 to 20 carbon atoms is preferably straight-chain and has 12, 14, 16 or 18 carbon atoms, e.g. oleoyl.

Suitable partial fatty acid esters of polyoxyethylene sorbitan are available commercially under the trademark Tween® of ICI and are known by the chemical names polyoxyethylene(20 or 4)-sorbitan monolaurate (TWEEN 20 and 21), polyoxyethylene-(20)-sorbitan monopalmitate or monostearate (TWEEN 40 and 60), polyoxyethylene-(4 or 20)-sorbitan monostearate or tristearate (TWEEN 61 and 65), polyoxyethylene-(20 or 5)-sorbitan monooleate (TWEEN 80 or 81) and polyoxyethylene-(20)-sorbitan trioleate (TWEEN 85).

It is advantageous to add a further antioxidant to the instant compositions, in particular an ester and/or ether of thiodipropionic or of thiodiacetic acid, which compounds replace some of the sulfur lost during the initial hydrogenation process. These compounds act as peroxide decomposers. While the thioether compound, $(C_{13}H_{27}OCOCH_2CH_2)_2S$, has been found to serve this purpose well, other thioethers and thioesters are equally advantageous. These further antioxidants are known and are incorporated in an affective stabilizing amount such as 5 to 30 weight %, more particularly 10 to 25 weight %, based upon the total weight of the stabilizer mixture, i.e., absent the weight of the lubricant.

It has now been surprisingly found that use of the instantly specified combination of the additives in lubricants, especially hydrotreated or hydrodewaxed oils, leads to unexpectedly superior performance characteristics. Significantly, the resulting compositions prepared with this technology, not only offer retardation of the oxidation process, but are also robust in use, and calcium compatible, to a much greater degree in accordance with the present invention than with other combinations of additives. Specifically, the combination of components (e) and (f) has been found to be very useful in providing calcium compatible robust rust inhibition to Group I, II and III base oils. It has also been found useful in providing calcium compatible robust rust inhibition to the base oils when in the presence of glycerol monooleate. In addition, any base oil, not limited to a hydrotreated or hydrodewaxed oil, may be stabilized as specified herein.

Another highly preferred embodiment of the invention relates to the lubricant composition as defined above which additionally contains an effective stabilizing amount of the above-mentioned polyol partial ester, a thioether or a thioester or a combination of these additional components.

The instant hydrotreated or hydrodewaxed oil compositions may optionally also contain various other additives in addition to the stabilizer mixture prescribed herein in order to further improve the basic properties thereof. These further additives comprise other antioxidants, metal deactivators and corrosion inhibitors as well as viscosity improvers, dispersants, detergents, extreme-pressure and antiwear additives, pour-point depressants, and the like.

Illustrative examples of such further additives are, but not limited to, the following:

Examples of Other Antioxidants

Aliphatic or aromatic phosphites, esters of thiodipropionic acid or of thiodiacetic acid, or salts of dithiocarbamic or dithiophosphoric acid.

Examples of Other Metal Passivators

Triazoles and other benzotriazoles and derivatives thereof, tolutriazole, 2-mercaptobenzothiazole, 5,5'-methylenebis-benzotriazole, 4,5,6,7-tetrahydrobenzotriazole, salicyclidenepropylenediamine and salicylaminoguanidine and salts thereof.

Examples of Other Rust Inhibitors

Other organic acids, their esters, metal salts and anhydrides, e.g. sorbitan monooleate, lead naphthenate, alkenyl succinic acids and anhydrides, e.g. dodecenyl succinic acid anhydride, succinic acid partial esters and amines;

Nitrogen-containing Compounds, e.g.

I. Primary, secondary or tertiary aliphatic or cycloaliphatic amines and amine-salts of organic and inorganic acids, e.g. oil-soluble alkyl-ammonium carboxylates;

II. Heterocyclic compounds, e.g. substituted imidazolines and oxazolines.

Phosphorus-containing compounds, e.g. amine salts of phosphonic acid or phosphoric acid partial esters, zinc dialkyldithiophosphates;

Sulfur-containing compounds, e.g. barium-dinonyl naphthalene-n-sulfonates, calcium petroleum sulfonates;

Derivatives of gamma-alkoxypropylamines described in Japanese Patent Publication No. 15783/1973;

Salts having the formula $Y—NH_3—R_{17}CO_2—$ wherein Y is a group $R_{18}Q_1CH_2CH(OH)CH_2$ wherein $R_{17}$ and $R_{18}$, independently, are e.g. alkyl and Q, is O, $CO_2$, NH, N(alkyl), N(alkenyl) or S, these salts being prepared by mixing an amine $Y—NH_2$ with an acid $R_{17}CO_2H$, as disclosed in DE-OS 3 437 876 (Published German Patent Application);

Compounds having the formula $R_{19}—Q_2—CH_2—CH(OH)—CH_2NR_{20}R_{21}$ wherein $Q_2$ is —O—, —S—, $—SO_2—$, —C(O)—O—, or $N(R_{19})$ wherein $R_{19}$ is H or $C_1$–$C_{12}$alkyl, $R_{20}$ is unsubstituted $C_1$–$C_4$alkyl or $C_2$–$C_5$alkyl substituted by one to three hydroxy groups, $R_{21}$ is hydrogen, unsubstituted $C_1$–$C_4$alkyl or $C_2$–$C_5$alkyl substituted by one to three hydroxy groups provided that at least one of $R_{20}$ and $R_{21}$ is hydroxy-substituted, and $R_{19}$ is $C_2$–$C_{20}$alkyl-$CH_2$—CH(OH)—$CH_2$—$NR_{20}R_{21}$ or $R_{19}$ is $C_2$–$C_{18}$alkenyl, $C_2$–$C_3$alkynyl or $C_3$–$C_{12}$cycloalkyl provided that, when $Q_2$ is —O— or —C(O)—O—, $R_{19}$ is branched $C_4$–$C_{20}$alkyl. These compounds are described in British Patent Specification 2 172 288A;

Compounds having the formula

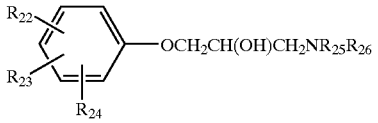

wherein $R_{22}$, $R_{23}$ and $R_{24}$ are, independently, hydrogen, $C_1$–$C_{15}$alkyl, $C_5$–$C_{12}$cycloalkyl, $C_6$–$C_{15}$aryl or $C_7$–$C_{12}$aralkyl and $R_{25}$ and $R_{26}$, independently, are hydrogen, 2-hydroxyethyl or 2-hydroxypropyl, provided that $R_{25}$ and $R_{26}$ are not simultaneously hydrogen and, when $R_{25}$ and $R_{26}$ are each $—CH_2CH_2OH$, $R_{22}$ and $R_{23}$ are not simultaneously hydrogen and $R_{24}$ is not pentyl. These compounds are described in Published European Patent Specification 252 007.

Examples of Viscosity-index Improvers

Polyacrylates, polymethacrylates, vinylpyrrolidone/methacrylate-copolymers, polyvinylpyrrolidones, polybutanes, olefin-copolymers, styrene/acrylate-copolymers, polyethers.

Examples of Pour-point Depressants

Polymethacrylates, alkylated naphthalene derivatives.

Examples of Dispersants/Detergents

Polybutenylsuccinic acid-amides or -imides, polybutenyl phosphonic acid derivatives, basic magnesium-, calcium-, and bariumsulfonates and -phenolates.

Examples of Anti-wear Additives and Extreme Pressure Additives

Sulfur- and/or phosphorus- and/or halogen-containing compounds, e.g. sulfurized vegetable oils, zinc dialkyldithiophosphates, tritolylphosphate, chlorinated paraffins, alkyl- and aryldi- and trisulfides, triphenylphosphorothionates and amine phosphates.

All of the foregoing optional additives are known in the art of formulating lubricating oils, and the person skilled in the art will be aware of the need to select thermally stable additives suitable to the end-use application of the particular lubricating product.

It further may be particularly beneficial, depending on the end-use, to add an antiwear additive, to the present lubricant compositions. U.S. Pat. Nos. 4,584,021; 5,798,321; 5,750,478; 5,801,130; 4,191,666; 4,720,288; 4,025,288; 4,025,583 and WO 095/20592 describe antiwear additives which may be used in the instant invention. These references are incorporated herein by reference. Other examples of amines are polyalkylene amines such as ethylene diamine, diethylene triamine, triethylene tetraamine, tetraethylene pentamine, pentaethylene hexamine, nonaethylene decamine and aryl amines as described in U.S. Pat. No. 4,267,063, herein incorporated by reference. Salts of amine phosphates comprising specialty amines and mixed mono- and di-acid phosphates have been found to be advantageous. The mono- and di-acid phosphate amines have the structural formulae:

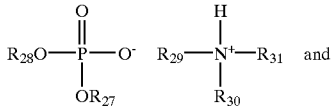

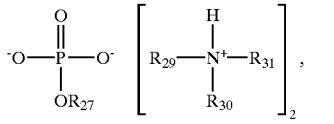

wherein $R_{27}$ is hydrogen, $C_1$–$C_{25}$ linear or branched chain alkyl which is unsubstituted or substituted by one or more $C_1$–$C_6$alkoxy groups, a saturated acyclic or alicyclic group, or aryl;

$R_{28}$ is $C_1$–$C_{25}$ linear or branched chain alkyl which is unsubstituted or substituted by one or more $C_1$–$C_6$alkoxy groups, a saturated acyclic or alicyclic group, or aryl;

$R_{29}$ is hydrogen, $C_1$–$C_{25}$ linear or branched chain alkyl, a saturated or unsaturated acyclic or alicyclic group, or aryl; and are hydrogen or $C_1$–$C_{12}$ linear or branched chain alkyl; and $R_{30}$ and $R_{31}$ are, each independently of the other, $C_1$–$C_{25}$ linear or branched chain alkyl, a saturated or unsaturated acyclic or alicyclic group, or aryl. Preferably, $R_{27}$ and $R_{28}$ are linear or branched $C_1$–$C_{12}$ alkyl; and $R_{29}$, $R_{30}$ and $R_{31}$ are linear or branched $C_1$–$C_{18}$ alkyl.

IRGALUBE 349 (CIBA) has been found to be very useful, particularly by enhancing the wear performance of the base oil such that it meets stringent military performance specifications. IRGALUBE 349 has the formula

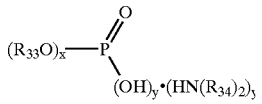

wherein $R_{33}$ is n-hexyl, $R_{34}$ is $C_{11}$–$C_{14}$ branched alkyl, and when x=1 then y=2; when x=2 then y=1.

A preferred embodiment relates a lubricant composition wherein (b) is 1-[bis(2-ethylhexyl)aminomethyl-4-methylbenzotriazole;

(c) is 3,5-di-tert-butyl-4hydroxyhydrocinnamic acid, $C_7$–$C_9$alkyl ester;

(d) is a phenylnapthylamine of the formula (VIII)

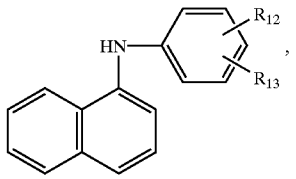

wherein $R_{12}$ represents hydrogen or $C_8$–$C_{13}$alkyl; or a diphenylamine of the formula (IX)

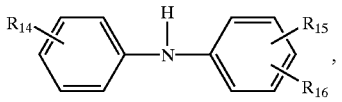

wherein $R_{12}$ is hydrogen and $R_{13}$ is hydrogen or $C_8$–$C_{13}$alkyl; or (e) is nonyl phenoxy acetic acid; and (f) is an N-acyl sarcosine of the formula $C_{17}H_{33}$—C(O)—N($CH_3$)—$CH_2$COOH.

The present invention also relates to the stabilizer mixture which consists of components (b)–(f) as defined above and the optional components. Typically, the stabilizer mixture is advantageously made up of about from between 5 and 30 weight %, more particularly from about 10 to 25 weight %, of component (b); 15 to 45 weight %, more particularly 20 to 40 weight %, of component (c); 25 to 60 weight %, more particularly 35 to 50 weight %, of component (d); 1 to 15 weight %, more particularly 2 to 10 weight %, of component (e); 0.1 to 10 weight %, more particularly 0.5 to 5 weight %, of component (f). In a preferred embodiment of the invention optional components selected from the group of 0.1 to 10 weight %, more particularly 0.5 to 5 weight %, of the above-mentioned polyol partial ester and 15 to 30 weight %, more particularly 20 to 25 weight % of a thioether derivative are present, based upon total weight of the stabilizer mixture. If necessary, 5 to 20 weight %, more particularly 10 to 15 weight %, of an appropriate solvent may be used as a diluent in the stabilizer mixture.

The mixture is incorporated into the hydrotreated or hydrodewaxed base stock in the range of from about 0.01 to about 3.0% by weight, based on total weight of the stabilized composition. An advantageous range is from 0.03 to 2.0%, and especially from about 0.15 to about 1.05%. The particular amount depends upon the targeted performance properties of the final lubricating oil product.

The instant invention further relates to a process for enhancing the performance properties of lubricating oils, in particular by retarding the oxidative degradation and thereby extending the life thereof. Thus, a process is claimed for stabilizing a hydrotreated or hydrodewaxed oil against the deleterious effects of heat and oxygen, which process comprises the step of adding to said oil effective stabilizing amounts of the above-mentioned composition.

The preferred embodiments relating to the stabilization of hydrotreated or hydrodewaxed oils also apply to all aspects of the present invention.

The compounds of components (b)–(f) and the optional components of the instant compositions can be blended with the hydrogenated or hydrodewaxed lubricating oil in a manner known per se. The compounds are, for example, readily soluble in oils. It is also possible to prepare a masterbatch, which can be diluted in accordance with consumption to suitable concentrations with the appropriate oil. In such case, much higher concentrations than those mentioned are possible.

The above antiwear additives are incorporated into the lubricant compositions in an effective stabilizing amount from about 0.01 to about 0.20 weight %, in particular from about 0.025 to about 0.18 weight %, based upon the total weight of the stabilized lubricant composition.

The instant invention also pertains to a corrosion inhibitor combination which can be added individually or as a mixture to a lubricant composition. This combination includes component (e) an alkyl phenoxy alkanoic acid of formula VI; component (f an N-acyl sarcosine of formula VII; plus a polyol partial ester, such as a glycerol monooleate. Examples of these combinations are seen in Tables IV and V. Component (e) is 35 to 90 wt %, preferably 45 to 85 wt %, component (f) is 8 to 60 wt %, preferably 10 to 55 wt %; and optional polyol partial ester is 0 to 35 wt %, preferably 0 to 30 wt %, all based on total mixture of component (e), (f) and polyol partial ester.

The following examples are presented for the purpose of illustration only and are not to be construed to limit the nature or scope of the present invention in any manner whatsoever. Unless indicated otherwise, parts and percentages are by weight.

EXAMPLE

Examples 1–9

Table I shows the compositions and test results of representative compositions 1–9 in accordance with the instant invention. The compositions are prepared by dissolving the indicated additives in the hydrotreated and/or hydrodewaxed or solvent refined oil by stirring at 60° C. for one hour.

Compositions 1–15 (Tables I and II) are evaluated for rust performance in accordance with ASTM D-665B, which is conducted in the presence of synthetic sea water. Results of the procedure are typically measured at 24 hours and, in order to meet the requirements of specifications such as MIL-17331 H, at 48 hours.

TABLE I

| | 1 | 2 | 3 | 4 | 5 | 6 | 7 | 8 | 9 |
|---|---|---|---|---|---|---|---|---|---|
| Oil(1) | 99.90 | — | — | 99.85 | 99.80 | 99.75 | 99.70 | 99.65 | 99.50 |
| Oil(2) | — | — | — | — | — | — | — | — | — |
| Oil(3) | — | 99.90 | — | — | — | — | — | — | — |
| Oil(4) | — | — | 99.90 | — | — | — | — | — | — |
| Alkylated diphenyamine(5) | 0.013 | 0.013 | 0.013 | 0.020 | 0.025 | 0.032 | 0.038 | 0.044 | 0.063 |
| Phenyl-alpha-naphthylamine(6) | 0.005 | 0.005 | 0.005 | 0.007 | 0.010 | 0.012 | 0.015 | 0.017 | 0.025 |
| Ditridecyl thiodipropionate(7) | 0.025 | 0.025 | 0.025 | 0.037 | 0.050 | 0.062 | 0.074 | 0.087 | 0.124 |
| 3,5-Di-tert-butyl-4-hydroxy-hydrocinnamic acid $C_7$–$C_9$alkyl | | | | | | | | | |

TABLE I-continued

| | 1 | 2 | 3 | 4 | 5 | 6 | 7 | 8 | 9 |
|---|---|---|---|---|---|---|---|---|---|
| esters[8] | 0.024 | 0.024 | 0.024 | 0.036 | 0.048 | 0.060 | 0.072 | 0.084 | 0.120 |
| Substituted tolutriazole[9] | 0.024 | 0.024 | 0.024 | 0.036 | 0.048 | 0.060 | 0.072 | 0.084 | 0.120 |
| Nonyl phenoxy acetic acid[10] | 0.008 | 0.008 | 0.008 | 0.012 | 0.016 | 0.021 | 0.025 | 0.029 | 0.041 |
| N-Acyl sarcosine[11] | 0.002 | 0.002 | 0.002 | 0.002 | 0.003 | 0.004 | 0.005 | 0.006 | 0.008 |
| Results of D665 Rust Test | | | | | | | | | |
| At 24 hours[12] | Pass | Pass | Pass | Pass | Pass | Pass | Pass | Pass | Pass |
| At 48 hours[12] | Fail | — | — | Pass | Pass | Pass | Pass | Pass | Pass |

The notes in Table I have the following meanings:
Component a)
[1]Hydrocracked, isodewaxed, hydrotreated base oil (Trade Name: RLOP 240N; Chevron)
[2]ISO 32 Hydrotreated base oil (P1810; Petro Canada)
[3]ISO 32 Hydrotreated refined base oil (HPO170; Sun Oil)
[4]ISO 46 Hydrotreated refined base oil (HPO 300; Sun Oil)
Additive Package
[5]IRGANOX L57 (CIBA)
[6]PANA (Fanwood Chemicals)
[7]Evanstab 13 (Hampshire Chemical Corp.)
[8]IRGANOX L135 (CIBA)
[9]IRGAMET 39 (CIBA)
[10]IRGACOR NPA (CIBA)
[11]Sarkosyl O (CIBA)

Compositions 1–15 show that the oil samples stabilized in accordance with a preferred embodiment of the instant invention (i.e. the specific combination of nonyl phenoxy acetic acid and N-acyl sarcosine of Compositions 1–9 exhibit a significant improvement in resistance to rust formation relative to the samples containing other combinations of additives. Oils stabilized in accordance with the instant invention pass the rust test at an additive concentration of around 0.1 weight %, whereas oils stabilized with comparative additive packages do not begin to pass until the additive concentration reaches about 0.5 weight %.

Table II shows that hydrotreated or hydrodewaxed oil stabilized in accordance with the instant invention meets the performance requirements of military specifications MIL-17672D as well as the performance targets of most R&O oils utilized in the marketplace. Compositions 2 and 3 are the same as indicated herein above for Table I.

TABLE II

| | Composition 2 | Composition 3 | 17672D Specification Limits |
|---|---|---|---|
| RPVOT (min.) | 295/310 | 385/400 | |
| TOST Life (hr.) | 3589 | 3285 | 1,000 (min.) |
| TOST Sludge (mg.) | 3.0 | 9.0 | 100 (max.) |
| | Acid Number = 0.4 | Acid Number = 0.3 | |
| Rust | Pass | Pass | Pass |
| Foam (ml.) | | | |
| Seq. 1 | 0/0[1] | 0/0[1] | 65/0 |
| Seq. 2 | 0/0[1] | 0/0[1] | 65/0 |
| Seq. 3 | 0/0[1] | 0/0[1] | 65/0 |
| Demulse | | | |
| Oil Layer (ml) | 42 (cloudy) | 43 (cloudy) | 40 (max.) |
| Water Layer (ml) | 38 (hazy) | 37 (hazy) | 40 (max.) |
| Emulsion Layer (ml) | 0 | 0 | 3 (max.) |
| Separation Time (min.) | 5 | 5 | 30 |
| Acid number of fluid (mg KOH/g) | 0.1 | 0.1 | 0.2 (max.) |
| Acid number of base stock (mg KOH/g) | 0.1 | 0.1 | — |

Note[1]: Antifoamer added to the composition

The RPVOT (Rotary Pressure Vessel Oxidation Test) in minutes is measured in accordance with ASTM D-2272. A longer oxidative lifetime is indicative of a better resistance to oxidation.

The TOST life (Oxidation characteristics of inhibited mineral oil) is measured in accordance with ASTM D943. The time to an acid number increase of 2.0 is measured (in hours). A longer lifetime indicates better resistance to oxidation of a particular lubricant composition. The acid numbers are measured by titration in accordance with ASTM D664.

The TOST sludge (determination of the sludging and corrosion tendencies of inhibited mineral oils) is measured in accordance with ASTM D4310. The lower the amount of sludge produced at the end of the test, the better is the resistance to oxidation of a particular lubricant composition.

The foaming characteristics of lubricating oils are measured in accordance with ASTM D-892. Low to no foaming is desirable. The first number indicates the volume of foam which is generated after blowing air through the oil for five minutes. The second number indicates the volume of foam which is present after ten minutes of no blowing of air through the oil.

The demulsibility (water separability of petroleum oils and synthetic fluids) is measured in accordance with ASTM D1401. High separation between lubricant and water is desirable. The results are reported as the volume of oil, volume of water and volume of emulsion generated after the mixture of both fluids has sat undisturbed for a given amount of time. The 1 7672D military specification requires that the fluids separate within 30 minutes into distinct layers, with maximum allowable level for the emulsion of 3 ml., for the oil of 40 ml., and for the water of 40 ml. Military specification 17331H requires the fluids to separate within 30 minutes into distinct layers, with maximum allowable levels for the emulsion of 0 ml., for the oil of 40 ml., and for the water of 40 ml.

Examples 10–15

Table III shows comparative compositions and test results of compositions 10–15:

TABLE III

| | 10 | 11 | 12 | 13 | 14 | 15 |
|---|---|---|---|---|---|---|
| Oil(2) | 99.55 | 99.50 | — | — | — | — |
| Oil(3) | — | — | 99.50 | — | 99.45 | — |
| Oil(4) | — | — | — | 99.50 | — | 99.45 |
| Alkylated diphenyl-amine(5) | 0.057 | 0.063 | 0.063 | 0.063 | 0.069 | 0.069 |
| Phenyl-alpha-naphthylamine(6) | 0.022 | 0.025 | 0.025 | 0.025 | 0.027 | 0.027 |
| Ditridecyl thiodi-propionate(7) | 0.112 | 0.124 | 0.124 | 0.124 | 0.136 | 0.136 |
| 3,5-Di-tert-butyl-4-hydroxy hydrocinnamic acid $C_7$–$C_9$alkyl esters(8) | 0.108 | 0.120 | 0.120 | 0.120 | 0.132 | 0.132 |
| Substituted tolutriazole(9) | 0.108 | 0.120 | 0.120 | 0.120 | 0.132 | 0.132 |
| Fatty amide of dodecenyl succinic acid(12) | 0.044 | 0.050 | 0.050 | 0.050 | 0.054 | 0.054 |
| Results of D665B rust test | | | | | | |
| At 24 hours | Fail | Pass | Fail | Fail | Pass | Pass |
| At 48 hours | Fail | — | Fail | Fail | — | — |

The notes in Table III have the following meanings:
(2)–(9)are as defined in Table I
(12)Hitec 536 (Ethyl)

Examples 16–31

Tables IV and V show comparative compositions 16–31 and test results. The compositions are prepared in the same manner as compositions 1–9. Compositions 16–31 are evaluated in accordance with ASTM D 665 Parts A and B. Part A of the procedure is conducted in the presence of distilled water. A sample is considered to have passed the test if not a single spot of rust is observed on the steel test specimen at the completion of the procedure. The demulsibility (water separability of petroleum oils and synthetic fluids) is determined in accordance with ASTM D1401. High separation between lubricant and water is desirable. The results are reported when the volumes of oil, water and the emulsion generated after the mixture of both fluids are undisturbed for a given amount of time. None of the corrosion inhibitors employed in the study negatively affect the water separability characteristics of the oil.

TABLE IV

| | 16 | 17 | 18 | 19 | 20 | 21 | 22 | 23 | 24 | 25 |
|---|---|---|---|---|---|---|---|---|---|---|
| N-Acyl sarcosine(1) | — | — | — | 0.03 | — | — | — | 0.015 | 0.03 | 0.015 |
| Nonylphenoxy acetic acid(2) | — | 0.03 | — | — | 0.015 | 0.015 | 0.03 | — | — | — |
| Glycerol monooleate(3) | — | — | 0.03 | — | 0.015 | 0.025 | 0.015 | 0.025 | 0.015 | 0.015 |
| Base package(4) | 0.29 | 0.29 | 0.29 | 0.29 | 0.29 | 0.29 | 0.29 | 0.29 | 0.29 | 0.29 |

TABLE IV-continued

| | 16 | 17 | 18 | 19 | 20 | 21 | 22 | 23 | 24 | 25 |
|---|---|---|---|---|---|---|---|---|---|---|
| Base Oil[5] | bal | bal | bal | bal | bal | bal | bal | bal | bal | bal |
| Results of D665A Rust Test 24 hours | Fail | Fail | Fail | Pass | Fail | Fail | Pass | Pass | Pass | Pass |
| Results of D665B Rust Test 24 hours | Fail | Fail | Fail | Fail | Fail | Fail | Fail | Pass | Pass | Pass |
| Demulse D 1401 (82° C.) Oil/Water/Emulsion | 42/38/0 | 43/37/0 | 44/36/0 | 43/37/0 | 43/37/0 | 43/37/0 | 43/37/0 | 41/39/0 | 41/39/0 | 41/39/0 |
| Elapsed Time (min) | 3 | 6 | 4 | 5 | 3 | 5 | 6 | 3 | 3.5 | 3 |

The Notes in Table IV have the following meanings:
[1] and [2] are defined in Table I
[3]Kessco ® GMO (Akzo)
[4]Base Package: 1500 ppm IRGANOX L 135 (3,5-Di-tert-butyl-4-hydroxyhydro-cinnamic acid $C_7$–$C_9$ alkyl esters; CIBA); 300 ppm IRGANOX L 57 (Alkylated diphenyl amine; CIBA); 400 ppm IRGAMET 39 (Substituted tolutriazoie; CIBA)
[5]Base Oil ISO 100 Solvent Refined Base Oil (Trade Name: Esso Solvent Neutral 600; Exxon): Viscosity 40° C.: 113 $mm^2/s$; Viscosity Index: 93; Sulfur Content: 0.5%; Aromatic Content: 8.8%

TABLE V

| | 26 | 27 | 28 | 29 | 30 | 31 |
|---|---|---|---|---|---|---|
| N-Acyl sarcosine[1] | — | 0.005 | 0.0255 | 0.005 | 0.005 | 0.005 |
| Nonyl Phenoxy acetic acid[2] | — | 0.0225 | 0.0485 | 0.0225 | 0.0225 | 0.024 |
| Glycerol monooleate[3] | — | — | — | 0.005 | 0.01 | 0.0032 |
| Base package[4] | 0.243 | 0.243 | 0.243 | 0.243 | 0.243 | 0.268 |
| Base oil[5] | bal | bal | bal | bal | bal | bal |
| Results of D 665 A Rust Test 24 hours | — | Fail | — | — | — | — |
| Results of D665 B Rust Test 24 hours | Fail | Fail | Fail | Pass | Pass | Pass |

The notes in Table V have the following meaning:
[1] and [2] are defined in Table I
[3] is defined in Table IV
[4]Base Package: 810 ppm BHT (Naugard ® BHT; Uniroyal Chemicals); 810 ppm IRGANOX L 135; 540 ppm IRGANOX L57TM; 135 ppm IRGAMET 30TM (CIBA); 135 ppm IRGAMET 39TM (CIBA)
[5]Base Oil: ISO 220 Hydrotreated Oil (Trade Name: Wintershall VG 220, Exxon): Viscosity 40° C.: 224 cSt Compositions 16–31 show that some base oils stabilized in accordance with another preferred embodiment of the instant invention (i.e. the specific combination of nonyl phenoxy acetic acid, N-acyl sarcosine and glycerol monooleate of Compositions 29–31 or the specific combination of N-acyl sarcosine and glycerol monooleate of Compositions 23–25) exhibit a significant improvement in resistance to rust formation as compared with compositions which do not contain this combination of rust inhibitor additives. These base oils stabilized in accordance with the instant invention pass the rust test at an additive concentration of about 0.03 wt. %. These base oils, when stabilized without glycerol monooleate do not pass the rust test.

Examples 32–37

Tables VI and VII show the compositions and test results of Compositions 32–42 prepared in accordance with the instant invention. The compositions are prepared as in Example 1. The D 665 B. RPVOT, TOST life and TOST sludge are measured for several of the Compositions.

The results are set forth in Tables VI and VII.

TABLE VI

| | 32 | 33 | 34 | 35 | 36 | 37 |
|---|---|---|---|---|---|---|
| Base Oil[1, 13] | 99.52 | 99.52 | 99.39 | 99.37 | 99.40 | 99.58 |
| Alkylated diphenylamine[2] | 0.10 | 0.10 | 0.08 | 0.08 | 0.13 | 0.15 |
| Phenyl-α-naphthylamine[3] | 0.08 | 0.08 | 0.10 | 0.10 | 0.17 | 0.060 |
| Ditridecyl thiodipropionate[4] | 0.04 | 0.04 | 0.05 | 0.05 | — | — |
| 3,5-di-tert-butyl-4 hydroxy-hydrocinnamic acid $C_7$–$C_9$ alkyl esters[5] | — | 0.18 | 0.25 | 0.25 | 0.14 | 0.15 |
| 2,6-di-tert-butyl-phenol[6] | 0.18 | — | — | — | — | — |
| Substituted tolutriazole[7] | 0.05 | 0.05 | 0.10 | 0.10 | 0.045 | 0.035 |
| Nonyl phenoxy acetic acid[8] | 0.025 | 0.025 | 0.025 | 0.042 | 0.028 | 0.01 |
| N-Acyl sarcosine[9] | 0.005 | 0.005 | 0.005 | 0.008 | 0.004 | 0.01 |
| Glycerol monooleate[10] | — | — | — | — | 0.007 | — |
| TEGDME[11] | — | — | — | — | 0.084 | — |
| Tolutnazole[12] | — | — | — | — | — | 0.005 |
| Results of D 665B Rust Test | | | | | | |

TABLE VI-continued

| | 32 | 33 | 34 | 35 | 36 | 37 |
|---|---|---|---|---|---|---|
| At 24 hours | Pass | Pass | Pass | Pass | Pass | Pass |
| RPVOT, D 2272 (min) | 956 | 744 | 946 | 878 | 1573 | 790 |

The Notes in Table VI have the following meanings:
(1)Hydrocracked, isodewaxed, hydrotreated base oil (Trade Name: RLOP 240N; produced by Chevron)
(6)IRGANOX L 140 (CIBA)
(11)Teraethyleneglycol dimethylether (Tetraglyme, Ferro Corp.)
(12)Tolutriazole (CIBA)
(13)Results presented for Formulation 37 have been generated in an ISO 46 hydrotreated base oil (Mobil Jurong; produced by ExxonMobil)
Notes 2, 3, 4, 5, and 7 to 19 are defined in Table I. Note 10 is defined in Table IV.

TABLE VII

| | 38 | 39 | 40 | 41 | 42 |
|---|---|---|---|---|---|
| Oil(1) | 99.85 | 99.40 | 99.29 | 98.95 | 99.19 |
| Alkylated diphenyl-amine(5) | 0.020 | 0.076 | 0.089 | 0.13 | 0.089 |
| Phenyl-a-naphthyl-amine(6) | 0.007 | 0.030 | 0.035 | 0.052 | 0.10 |
| Ditridecyl thiodipro-pionate(7) | 0.037 | 0.15 | 0.18 | 0.26 | 0.18 |
| 3,5-Di-tert-butyl-4-hydroxy-hydro-cinnamic acid, $C_7$–$C_9$ alkyl esters(8) | 0.036 | 0.14 | 0.17 | 0.25 | 0.17 |
| Substituted tolutriazole(9) | 0.036 | 0.14 | 0.17 | 0.25 | 0.20 |
| Nonyl phenoxy acetic acid(10) | 0.012 | 0.050 | 0.059 | 0.087 | 0.059 |
| N-acyl sarcosine(11) | 0.002 | 0.010 | 0.012 | 0.017 | 0.012 |
| RPVOT (min.) | 302 | — | 838 | 878 | 1073 |
| TOST life (hr.) | 3589 | 4875 | 6753 | 8738 | 9992 |
| TOST sludge (mg.) | 3.0 | 63 | 41 | 67 | 27 |

Notes 1 and 5 to 11 have been defined in Table I.

Examples 43–44

IRGALUBE 349 (amines, $C_{11}$–$C_{14}$ branched alkyl, compounds with dihexyl phosphate and monohexyl phosphate) is included (0.16 weight percent) in the lubricant composition of Composition Nos. 2 and 3, to form Composition Nos. 43 and 44, respectively. Composition Nos. 43 and 44 are then subjected to performance requirements of MIL-17331H. The results are set forth in Table VIII.

TABLE VIII

| | 43 | 44 | MIL-17331H Specification Limits |
|---|---|---|---|
| RPVOT (min.) | 90 | 115 | |
| TOST Life (hr.) | 3769 | 3403 | 1000 (min.) |

TABLE VIII-continued

| | 43 | 44 | MIL-17331H Specification Limits |
|---|---|---|---|
| TOST Sludge (mg.) | 23 Acid Number = 0.3 | 14 Acid Number = 0.2 | 100 (max.) |
| Rust Test | Pass | Pass | Pass after 48 hours |
| Foam (ml.) | | | |
| Seq. 1 | 0/0 | 0/0 | 65/0 |
| Seq. 2 | 0/0 | 0/0 | 65/0 |
| Seq. 3 | 0/0 | 0/0 | 65/0 |
| Demulse (ml.) | | | |
| Oil Layer (ml) | 43 (cloudy) | 43 (cloudy) | 40 |
| Water Layer (ml) | 37 (clear) | 37 (clear) | 40 |
| Emulsion Layer (ml) | 0 | 0 | 0 |
| Separation Time (min.) | 15 | 10 | 30 |
| Acid number of fluid (mg KOH/g) | 0.2 | 0.3 | 0.3 (max.) |

Note: 1 Antifoamer added to the formulation.

The RPVOT, TOST life, TOST sludge, Foaming and Demulsibility are measured as described above. The wear (Four Ball Wear Test) is measured in accordance with Federal Standard 791, Method 6503. A lower scar diameter, which is generated at the end of the test, indicates better resistance to wear provided by a particular lubricant composition.

Examples 45–49

The calcium compatibility of Compositions prepared in accordance with the present invention is compared to comparative Compositions. Compositions 45 and 46 are prepared in accordance with the instant invention in a manner analogous to Compositions 1–9 above. Composition 47 contains Hitec 575, which is a rust and oxidation package from Ethyl Corporation. Composition 48 contains the same components in the same amounts as Compositions 45 and 46, except using a succinic acid half ester (IRGACOR L 12) in place of the instant corrosion inhibitor. Composition 49 contains the same components in the same amounts as Compositions 45 and 46, except using an alkylated acid/ester (Lubrizol 859) in place of the instant corrosion inhibitor. The results of the calcium compatibility study are set forth in Table IX:

TABLE IX

| Composition | 45 | 46 | 47 | 48 | 49 |
|---|---|---|---|---|---|
| Concentration (weight %) | 0.5 | 1.05 | 0.5 | 0.5 | 0.5 |
| Filterability Index | 1.1 | 1.0 | >2 | >>2 | >>>2 |

Calcium compatibility is generated in accordance with the following procedure: 300 ml of sample containing 0.1 volume-% deionized water and 30 ppm calcium contamination is sealed and stored at 70° C. for 96 hours. The sample is then stored for 48 hours in the dark. The time is recorded for each 100 ml of filtered fluid. The filterability index (FI) is determined by the following formula: $FI=[T_{300}-T_{200}]/[2(T_{100}-T_{50})]$, where $T_N$ represents the time for a particular volume of oil (i.e., 50 ml, 100 ml, 200 ml, or 300 ml) to travel through a filter. A filterability index of <2 is desirable and is considered a "pass". A filterability index of ≧2 is not desirable and is considered a "fail".

As the results show, Compositions prepared in accordance with the instant invention are calcium compatible and pass the calcium compatibility test while the comparative Compositions are not calcium compatible and fail the test.

What is claimed is:

1. A lubricant composition which comprises (a) a hydrotreated oil or a hydrodewaxed oil;

(b) (i) an effective stabilizing amount of a metal deactivator of the formula (I)

(I)

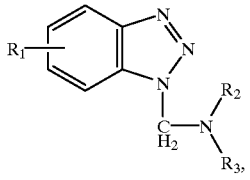

wherein $R_1$ is hydrogen or $C_1$–$C_{12}$alkyl, and $R_2$ and $R_3$, each independently of the other, are hydrogen, $C_1$–$C_{20}$alkyl, $C_3$–$C_{20}$alkenyl, $C_5$–$C_{12}$cycloalkyl, $C_7$–$C_{13}$aralkyl, $C_6$–$C_{10}$aryl, hydroxy, or $R_2$ and $R_3$, together with the nitrogen to which they are bonded, form a 5-, 6- or 7-membered heterocyclic residue or $R_2$ and $R_3$ is each a residue of the formula (II)

$$R_4X[(\text{alkylene})O]_n(\text{alkylene})— \quad (II),$$

wherein

X is O, S or $NR_4$;

$R_4$ is hydrogen or $C_1$–$C_{20}$alkyl;

alkylene is a $C_1$–$C_{12}$alkylene residue; and n is 0 or an integer from 1 to 6; or $R_2$ is as defined above and $R_3$ is a residue of the formula (III)

(III)

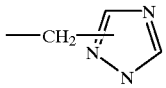

or is a residue of the formula (II) as defined above and $R_2$ is a residue of the formula (IV)

$$-[\text{alkylene}]_n—N(R_5)—A—[N(R_5)_2]_m \quad (IV),$$

wherein m is 0 or 1 and, when m is 0, A is a residue of the formula (III) and, when m is 1, A is alkylene or $C_6$–$C_{10}$ arylene; and alkylene and n have their above-mentioned meanings; and $R_5$ is a residue of the formula (III), as defined above; or (ii) an effective stabilizing amount of a metal deactivator of the formula (V)

(V)

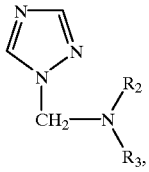

wherein $R_2$ and $R_3$ are as defined above;

(c) an effective stabilizing amount of a sterically hindered phenolic antioxidant;

(d) an effective stabilizing amount of an aromatic amine antioxidant;

(e) an effective stabilizing amount of an alkyl phenoxy alkanoic acid of the formula (VI)

(VI)

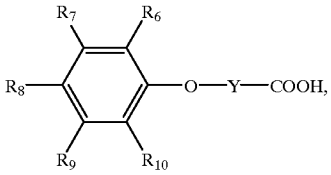

wherein $R_6$, $R_7$, $R_8$, $R_9$ and $R_{10}$ are, each independently of the other, hydrogen or $C_1$–$C_{20}$alkyl and Y is a divalent $C_1$–$C_{20}$ hydrocarbon radical, saturated or unsaturated, selected from the group consisting of

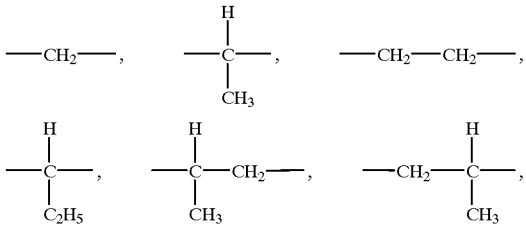

and —$CH_2$—$CH_2$—$CH_2$—; and (f) an effective stabilizing amount of an N-acyl sarcosine derivative of the formula (VII)

(VII)

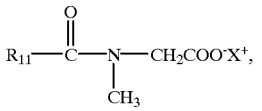

wherein the acyl group $R_{11}$—C(═O)— is the residue of a fatty acid having 10 to 20 carbon atoms and $X^+$ is the hydrogen ion, an alkali metal ion or an ammonium ion.

2. A lubricant composition according to claim 1, which additionally contains an effective stabilizing amount of a polyol partial ester, a thioether or a thioester or a combination of these additional components.

3. A lubricant composition according to claim 1 further comprising $(C_{13}H_{27}OCOCH_2CH_2)_2S$.

4. A lubricant composition according to claim 1 wherein the metal deactivator of the formula I is 1-[bis(2-ethylhexyl) aminomethyl-4-methyl]benzotriazole.

5. A lubricant composition according to claim 1 wherein the metal deactivator of the formula I is 1-[bis(2-ethylhexyl) aminomethyl)-1,2,4-triazole.

6. A lubricant composition according to claim 1 wherein the alkyl phenoxy alkanoic acid of component (e) is selected from the group consisting of phenoxy acetic acid, p-methyl phenoxy acetic acid, p-isopropyl phenoxy acetic acid, p-octyl phenoxy acetic acid, p-nonyl phenoxy acetic acid, p-dodecyl phenoxy acetic acid, p-(alpha-methyl-methyl-nonadecyl) phenoxy acetic acid, 2,4-di-tert-amyl phenoxy acetic acid, 2,4-di-sec-amyl phenoxy acetic acid, 2,4-dinonyl phenoxy acetic acid and 2-methyl-6-tert-butyl phenoxy acetic acid.

7. A lubricant composition according to claim 1 wherein the N-acyl sarcosine derivative of component (f) is selected from the group consisting of lauroyl sarcosine, cocyl sarcosine, oleoyl sarcosine, stearoyl sarcosine, and tall oil acyl sarcosine, or the corresponding alkali metal or ammonium sarcosinates.

8. A lubricant composition according to claim 1 wherein the sterically hindered phenolic antioxidant of component (c) is 2,6-di-tert-butyl phenol, BHT, 2,2'-methylene bis-(4, 6-di-tertbutyl), 1,6-hexamethylene-bis-(3,5-di-tert-butyl-4-hydroxyhydrocinnamate), ((3,5-bis(1,1dimethylethyl-4-hydroxyphenyl)methyl)thio) acetic acid, $C_{10}$–$C_{14}$isoalkyl esters, 3,5-di-tert-butyl4-hydroxyhydrocinnamic acid, $C_7$–$C_9$alkyl esters, tetrakis-(3-(3,5-di-tert-butyl-4-hydroxyphenyl)-propionyloxymethyl)methane, thiodiethylene bis(3,5-di-tert-butyl-4-hydroxyhydrocinnamate), octadecyl 3,5-di-tert-butyl-4-hydroxyhydrocinnamate or 2,5-di-tert-butylhydroquinone.

9. A lubricant composition according to claim 1 wherein the sterically hindered phenolic antioxidant of component (c) is 3,5di-tert-butyl-4-hydroxyhydrocinnamic acid, $C_7$–$C_9$alkyl esters.

10. A lubricant composition according to claim 1 wherein the aromatic amine antioxidant of component (d) is N,N'-di-isopropyl-p-phenylenediamine, N,N'-di-sec-butyl-p-phenylenediamine, N,N'-bis(1,4dimethyl-pentyl)-p-phenylenediamine, N,N'-bis)1-ethyl-3-methyl-pentyl)-p-phenylene-diamine, N,N'-bis(1-methyl-heptyl)-p-phenylenediamine, N,N'-dicyclohexyl-p-phenylenediamine, N,N'-diphenyl-p-phenylenediamine, N,N'-di(2-naphthyl)-p-phenylenediamine, N-isopropyl-N-'-phenyl-p-phenylenediamine, N-(1,3-dimethylbutyl)-N'-phenyl-p-phenylenediamine, N-(1-methylheptyl)-N'-phenyl-p-phenylenediamine, N'-cyclohexyl-N'-phenyl-p-phenylenediamine, 4-(p-toluenesulfoamide)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, e.g. p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di(4-methoxyphenyl)amine, 2,6-di-tert-butyl-4-dimethylaminomethylphenol, 2,4'-diaminodiphenylmethane, 4,4'-diaminodiphenylmethane, N,N,N',N'-tetramethyl-4,4'-diaminodiphenylmethane, 1,2-di(phenylamino)ethane, 1,2-di[(2-methylphenyl)amino]ethane, 1,3-di(phenylamino)propane, (o-tolyl)biguanide, di[4-(1',3'-dimethylbutyl)phenyl]amine, tert-octyldiphenylamines, 2,3-dihydro-3,3-dimethyl-4H-1,4-benzothiazine, phenothiazine, N-allylphenothiazine, tert-octylated phenothiazine, or 3,7-di-tert-octylphenothiazine.

11. A lubricant composition according to claim 1 wherein the aromatic amine antioxidant of component (d) is a compound of the formula (VIII)

(VIII)

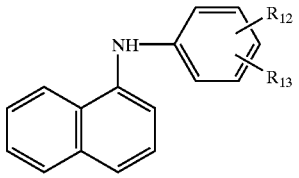

wherein $R_{12}$ and $R_{13}$ are, each independently of the other, hydrogen or $C_1$–$C_{24}$ alkyl.

12. A lubricant composition according to claim 11 where $R_{12}$ is hydrogen and $R_{13}$ is hydrogen or $C_8$–$C_{13}$alkyl.

13. A lubricant composition according to claim 1 wherein the aromatic amine antioxidant is a compound of the formula (IX), or mixtures thereof, (IX)

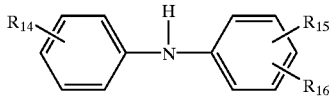

wherein $R_{14}$, $R_{15}$ and $R_{16}$ are, each independently of the other, hydrogen or $C_1$–$C_{24}$alkyl.

14. A lubricant composition according to claim 13 wherein the amine antioxidant is a mixture of alkylated diphenylamines where $R_{14}$, $R_{15}$ and $R_{16}$ are, independently of the other, hydrogen, —$C_4H_9$ or —$C_8H_{17}$.

15. A lubricant composition according to claim 1 wherein the N-acyl sarcosine derivative contains an acyl group having from 12 to 18 carbon atoms.

16. A lubricant composition according to claim 1 wherein $R_{11}$ is —$C_{17}H_{33}$ and X is hydrogen in the N-acyl sarcosine derivative of formula (VI).

17. A lubricant composition according to claim 1 wherein (b) is 1-[bis(2-ethylhexyl)aminomethyl-4-methylbenzotriazole;

(c) is 3,5-di-tert-butyl-4-hydroxyhydrocinnamic acid, $C_7$–$C_9$alkyl ester;

(d) is a phenylnapthylamine of the formula (VIII)

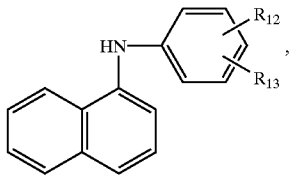

wherein $R_{12}$ represents hydrogen or $C_8$–$C_{13}$alkyl; or a diphenylamine of the formula (IX)

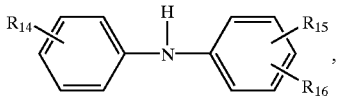

wherein $R_{12}$ is hydrogen and $R_{13}$ is hydrogen or $C_8$–$C_{13}$alkyl; or (e) is nonyl phenoxy acetic acid; and (f) is an N-acyl sarcosine of the formula $C_{17}H_{33}$—C(O)—N($CH_3$)—$CH_2$COOH.

18. A lubricant composition according to claim 1 which further comprises an additive, or mixtures thereof, selected from a further antioxidant, a further metal deactivator, a further corrosion inhibitor, a viscosity improver, a dispersant, a detergent, an extreme-pressure and antiwear additive and a pour-point depressant.

19. A process for stabilizing a hydrotreated oil or hydrodewaxed oil against the deleterious effects of heat and/or oxygen, which process comprises adding to said oil an effective stabilizing amount of components (b), (c), (d), (e) and (f) as described in claim 1.

20. A process for stabilizing a hydrotreated oil or hydrodewaxed oil against the deleterious effects of heat and/or oxygen, which process comprises adding to said oil an effective stabilizing amount of components (b), (c), (d), (e) and (f) as described in claim 17.

21. A lubricant composition according to claim 1 further comprising an ether of thiodipropionic acid.

22. A lubricant composition according to claim 1 further comprising mixed mono- and di- acid phosphate amines of the formula

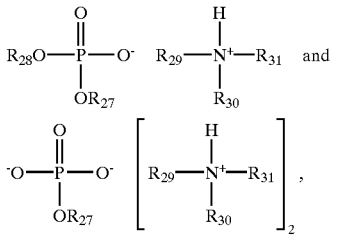

wherein $R_{27}$ is hydrogen, $C_1$–$C_{25}$ linear or branched chain alkyl which is unsubstituted or substituted by one or more $C_1$–$C_6$alkoxy groups, a saturated acyclic or alicyclic group, or aryl;

$R_{28}$ is $C_1$–$C_{25}$ linear or branched chain alkyl which is unsubstituted or substituted by one or more $C_1$–$C_6$alkoxy groups, a saturated acyclic or alicyclic group, or aryl;

$R_{29}$ is hydrogen, $C_1$–$C_{25}$ linear or branched chain alkyl, a saturated or unsaturated acyclic or alicyclic group, or aryl; and are hydrogen or $C_1$–$C_{12}$ linear or branched chain alkyl; and $R_{30}$ and $R_{31}$ are, each independently of the other, $C_1$–$C_{25}$ linear or branched chain alkyl, a saturated or unsaturated acyclic or alicyclic group, or aryl, Preferably, $R_{27}$ and $R_{28}$ are linear or branched $C_1$–$C_{12}$ alkyl; and $R_{29}$, $R_{30}$ and $R_{31}$ are linear or branched $C_1$–$C_{18}$ alkyl.

23. A lubricant composition according to claim 1 which further comprises

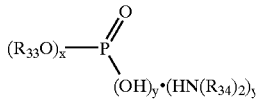

wherein $R_{33}$ is n-hexyl, $R_{34}$ is $C_{11}$–$C_{14}$ branched alkyl, and when x=1 then y=2; when x=2 then y=1.

24. A stabilizer mixture suitable for stabilizing a lubricant against the deleterious effects of heat and/or oxygen which comprises (b) a metal deactivator of formula I or of formula II, as described in claim 1;

(c) a sterically hindered phenolic antioxidant;

(d) an aromatic amine antioxidant;

(e) an alkyl phenoxy alkanoic acid of formula IV, as described in claim 1; and (f) an N-acyl sarcosine derivative of formula VII, as described in claim 1;

where on weight percent based on the total stabilizer mixture component (b) is 5 to 30%;

component (c) is 15 to 45%;

component (d) is 25 to 60%;

component (e) is 1 to 15%; and component (f) is 0.1 to 10%.

25. A stabilizer mixture according to claim 24 where on weight percent based on the total stabilizer mixture component (b) is 10 to 25%;

component (c) is 20 to 40%;

component (d) is 35 to 50%;

component (e) is 2 to 10%; and component (f) is 0.5 to 5%.

26. A corrosion inhibitor combination which can be added individually or as a mixture to a lubricant composition comprising a combination (e) an alkyl phenoxy alkanoic acid of formula VI, as described in claim 1; (f) an N-acyl sarcosine derivative of formula VII, as described in claim 1; plus optionally a polyol partial ester; where component (e) is 35 to 90 wt %; component (f) is 8 to 60 wt %; and optional polyol partial ester is 0 to 35 wt %, based on mixture of component (e), (f) and polyol partial ester.

27. A combination according to claim 26 where component (e) is 45 to 85 wt %, component (f) is 10 to 55 wt % and optional polyol partial ester is 0 to 30 wt %.

* * * * *